United States Patent [19]

Besnard

[11] 4,125,070

[45] Nov. 14, 1978

[54] PRESS FOR SQUEEZING JUICE FROM LIGNEOUS PLANTS AND MATERIAL

[76] Inventor: René J. Besnard, 32 Rue de Brest, Vitre, France, 35500

[21] Appl. No.: 791,043

[22] Filed: Apr. 26, 1977

[30] Foreign Application Priority Data

Apr. 27, 1976 [FR] France ..... 7613075

[51] Int. Cl.[2] ..... B30B 9/06

[52] U.S. Cl. ..... 100/116; 100/121

[58] Field of Search ..... 100/116, 118, 112, 121, 100/70 A, 174, 47

[56] References Cited

U.S. PATENT DOCUMENTS

| | | | |
|---|---|---|---|
| 221,386 | 11/1979 | Barnes | 100/121 |
| 1,456,430 | 5/1923 | Fisher | 110/121 |
| 1,492,563 | 5/1924 | Headson | 110/118 |

*Primary Examiner*—Leonard D. Christian

*Attorney, Agent, or Firm*—Charles A. Laff; J. Warren Whitesel; Howard B. Rockman

[57] ABSTRACT

A press comprises a pressure roller of relatively large diameter cooperating with a plurality of satellite rollers, the material to be pressed passing between the pressure roller on the one hand and the plurality of satellite rollers on the other hand, each satellite roller having a lateral surface presenting a series of circular grooves, the bottom of the grooves being partially or completely empty to allow the squeezed-out liquid to pass.

5 Claims, 6 Drawing Figures

PRESS FOR SQUEEZING JUICE FROM LIGNEOUS PLANTS AND MATERIAL

The present invention concerns a press suitable for squeezing the juice contained in ligneous plants or ligneous materials. By ligneous plants or materials is understood for example lucerne or the fruit pulp.

There have been known for a long time presses intended for the treatment of cider apples, such as the press described in French Pat. No. 665,528, and there have been developed more recently machines capable of squeezing the liquid contained in muds such as the machine described in French patent application No. 74.00878. In these presses or machines, the materials to be treated passes between endless bands pressed by rollers. However, this type of machine is no longer suitable when it is a matter of treating ligneous materials in which the proportion of liquid is comparatively smaller and the resistance of the solid material is greater. It is necessary in order to crush a ligneous material to exercise a force greater than that achievable with the use of endless belts.

One object of the invention consists in providing a press with rollers, without endless belts, subjected to a pinching which permits of extracting the juice of ligneous material under better conditions than those of known methods.

According to one feature of the invention there is provided a press comprising a pressure roller of relatively large diameter co-operating with a plurality of satellite rollers, the material to be pressed passing between the pressure roller on the one hand and the plurality of satellite rollers on the other hand, each satellite roller having a lateral surface presenting a series of circular grooves, the bottom of the grooves being partially or completely empty to to allow the squeezed-out liquid to pass.

According to another feature, the grooves have a width which is small in respect of the fibres of the material to be treated, this width being a simple fraction of the gap between two grooves.

According to another feature, each satellite roller is constituted by a stack of discs of the same diameter separated from one another by smaller spaced washers, a gap between two discs at the periphery of the roller defining a groove without base.

According to another feature, the discs are hollow in the centre and the stacking is held by pins likewise passing through the washers.

According to another feature, the press comprises in addition, in respect of the pressure roller between two successive satellite rollers, guide plates guiding the material to be treated between the satellite rollers.

According to another feature, the guide plates carry teeth forming a fork turned towards the satellite roller which precedes each plate, the teeth penetrating into the grooves of this satellite roller to disengage the materials encrusted in the grooves.

According to another feature, the guide plates are each constituted by a stack of plates which are alternately short and long, the portions projecting beyond the long plates constituting the teeth, the upper part of the small plates defining a plane surface which is that of the plate.

According to another feature, in a stack of small plates the long small plates have a slightly less thickness, almost the same as the gap between the two discs of a satellite roller, whilst the short small plates have a thickness slightly greater than that of the discs.

The features mentioned above as well as others will appear more clearly from reading the following description of one embodiment, the said description being made with reference to the attached drawings, of which:

Figure 1:
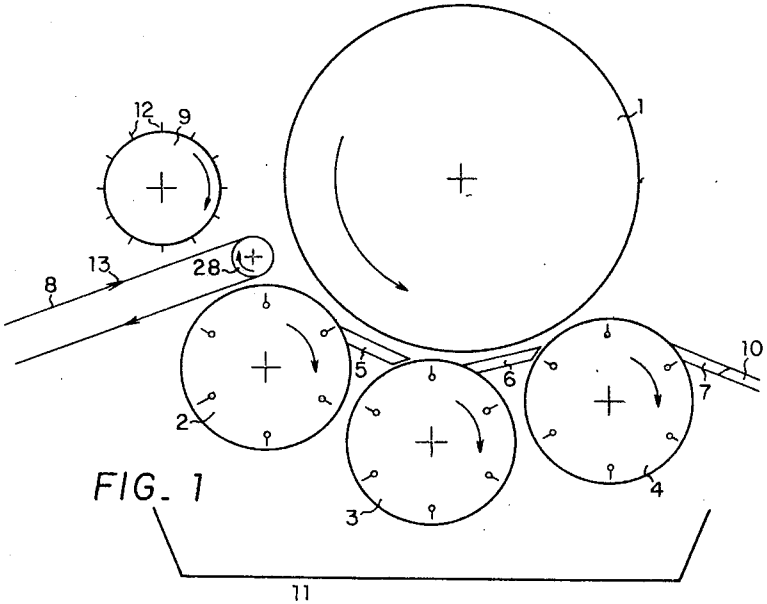
FIG. 1 shows a diagrammatic side view of a press according to the invention.

In FIG. 1, the press comprises a pressure roller 1, three satellite rollers 2–4, three guide plates 5–7, an endless feed belt 8, a regulator roller 9, an overflow 10 and a juice-receiving trough 11. The adjusting roller 9 has on its surface picks 12 and serves for limiting the thickness of the ligneous material 13 transported by the belt 8. The pressure roller has a substantial diameter, about twice that of each of the satellite rollers. The pressure roller has a grooved surface to take along the materials in the direction of the arrow. It is preferably covered by a coating of rubber or other elastomer over the whole of its active surface.

Figure 2:
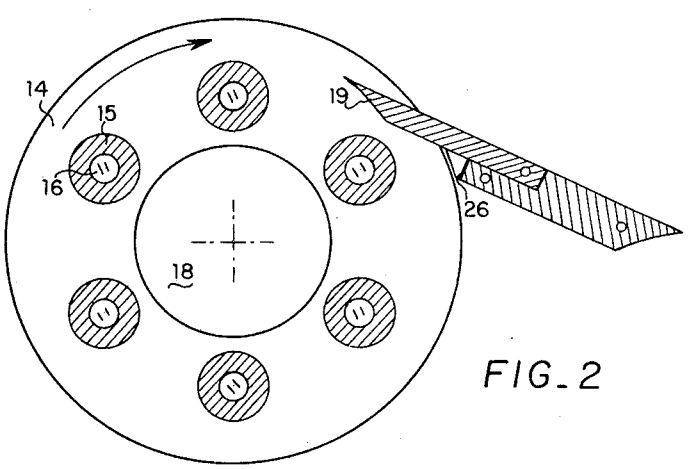
FIG. 2 is an enlarged view in section of a satellite roller associated with a guide plate.
Figure 3:
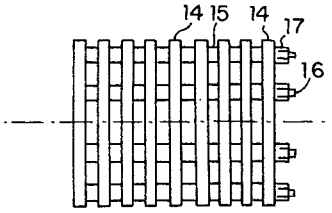
FIG. 3 is a front view of a satellite roller.

As FIGS. 2 and 3 show, a satellite roller such as 2, 3 or 4 is constituted by a stack of discs or circular plates 14 which are disposed co-axially and separated one from the other by washers 15. The washers 15 are preferably circular washers. The discs 14 and the washers 15 are held in place by pins 16 which pass alternately in a hole pierced in a disc then in the central hole of the washer. At their ends the stems of the pins 16 are threaded to receive clamping screws 17. Preferably, the discs 14 have central apertures 16 and form circular rims.

The discs 14 all have the same thickness which may be, for example, from 2 to 4mm according to the materials to be treated. The washers 15 all have the same thickness and may be, for example, from 0.5 to about 1mm according to the materials to be treated. Thus, the gaps defined by the washers 15 between the discs 15 form grooves, the depth of which, for the solid part of the materials to be treated, is practically defined by the circle described on the washers 15. On the other hand, as regards the juice squeezed out of the materials, the grooves are without base. The apertures 18 in the discs have the object of reducing the contacting surface between the discs and the juice which reduces the possibility of sticking of the juices on the discs and which obviates the clogging of the grooves.

FIG. 2 shows likewise a guide plate which is extended between the discs 14 by the teeth 19, which permit of scraping or disengaging the solid materials which become wedged on the periphery of the grooves. It is obvious that the teeth are completely on the outside of the circle circumscribed on the washers 15.

Figure 4:
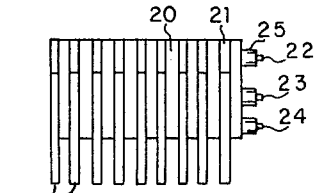
FIG. 4 is a view from above of a guide plate.

FIG. 4 shows a view from above of a guide plate constituted by a stack of short small plates 20 and long small plates 21 which are held clamped together by a system of pins 22–24 provided with clamping screws 25. A short small plate 20 has a thickness slightly greater than that of a disc 14 whilst a long small plate 21 has a thickness slightly less than a washer 15. Small plates 20 and 21 are disposed alternately and the lateral regulation of the guide plates in respect of the satellite rollers which precede them respectively is such that the long small plates are opposite the grooves between the discs and penetrate therein as FIG. 2 shows. The differences of thickness mentioned above are necessary to avoid the wedging of the teeth 19 constituting the end of each long small plate 21 between the discs 14.

Figure 5:
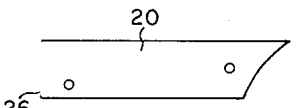
FIG. 5 is a side view of a small short plate of a guide plate.

FIG. 5 shows a side view of a short small plate 20, the front corner 26 of which is very near the preceding roller as FIG. 2 indicates. The rear part of 20 arcuately is hollowed to ensure the guiding of the materials 13 as far as the following roller by avoiding as much as possible the falling of material between the rear of the guide plate and the following roller or between the rear of the plate 7 and the overflow 10.

Figure 6:
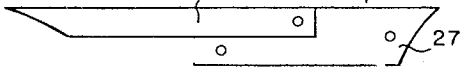
FIG. 6 is a side view of a tooth and of a small stop plate of a guide plate.

FIG. 6 shows a side view of a small long plate 21 which is preferably constituted by two parts, that is, at the front a tooth 19 and at the rear a heel 27. The front corner of heel 27 is aligned with 26 so as to form a straight ridge with the small plates 20. At the rear, the heel 27 has the same shape as 20. At the base the tooth 19 is placed as indicated in FIG. 6 in a notch of the heel 27. The heights of 20 and 21 are equal. The small plates 20 and the heels 27 are connected by pins 22 and 24. Once the assembly of 20 and 27 is realised, the teeth 19 are placed in the gaps left free and are then locked in position by the pin 23. This arrangement permits of exchanging rapidly the teeth 19 which may be damaged in the course of operation of the press.

The operation of the press is as follows. The ligneous material to be treated mounts on to the belt 8. Roller 9 with its points 12 rotates in the direction of the arrow and limits the thickness of the layer of material which is poured between the pressure roller 1 and the satellite roller 2 beyond the drum 28 guiding the belt 8. The material is pressed a first time between 1 and 2, the juice flows between the discs 14 of 2 into the trough 11, the remaining solid material is taken along by the roller 1 onto the plate 5 to be again pressed between 1 and 3 and so on until the solid material is discharged by 10. The rollers 1 to 4 being relatively hard, the pressure exercised on the material is sufficient to extract the juice. Between two satellite rollers on the guide plates the material is a little decompressed and re-arranged which improves the following pressing.

The discs 14, the washers 15, small plates 20 and 21 are of stainless steel or other rustless material which permits of easy cleaning. The surface of 1 is of elastomer to take the materials along better. The roller 1 has a tangential speed slightly greater than that of the rollers 2 to 4 to avoid any cramming. The rollers 1 to 4 and 28 are of course driven by suitable mechanical systems which may be conventional and which are not shown. The axles of the rollers are adjustable in position to permit of varying the distance apart between 1 on the one hand and 2 to 4 on the other hand according to the material to be treated. The end discs 14 of each roller 2 to 4 are preferably solid to permit of driving along by a central axle.

In the case of presses of relatively small dimensions, instead of using in the satellite rollers several separate individual washers between two discs, (as in the example described where there are six washers between two discs) one may be led to use only one washer in the form of a rim of smaller diameter than that of the disc to form grooves between the two discs. In this case, there may be provided a tubular axis passing successively through one disc and a concentric wedge, the inner diameter of the washers and of the discs being equal.

It must of course be understood that the rollers have transverse dimensions according to the delivery of the materials to be treated on condition that they are compatible with the standards of safety in force, if the press is mounted on a vehicle, and that they do not exceed the mechanical possibilites of the axles or shafts.

The press may be completed by lateral walls obviating the lateral losses of materials.

Although the principles of the present invention have been described above in relation to one particular embodiment, it must be understood that the said description has been made only by way of example and does not limit the scope of the invention.

I claim:

1. A press suitable for squeezing out the juice contained in plants or ligneous materials, the fibers of which have a diameter of the order of a few millimeters, the fibers being cut into short pieces, said press comprising a pressure roller having a substantially smooth surface and a relatively large outside diameter, a plurality of cylindrical satellite rollers cooperatingly mounted adjacent and in contact with said pressure roller, the material to be pressed passing between the pressure roller with said substantially smooth surface and the plurality of satellite rollers, each of said satellite rollers having a lateral surface with a series of circular grooves formed thereon, the base of the grooves being open to allow the squeezed-out liquid to pass between two grooves, and the circular grooves have at least the initial portion of their faces parallel and perpendicular to the axis of the roller.

2. A press according to claim 1, wherein the grooves have a small width in relation to the fibers of the material to be treated, this width being a simple fraction of the gap between the two grooves.

3. A press according to claim 1, comprising in addition, at least one guide plate means associated with the pressure roller and positioned between two successive satellite rollers, being constituted from a stack of small plates which are alternately short and long, the portions of the long plates extending beyond the short small plates constituting the teeth of the fork and the upper part of the small plates defining a plane surface which is that of the plate, said guide plate guiding the material to be treated betwen the two satellite rollers, said guide plate carrying teeth forming a comb or fork turned toward and pointing at the satellite roller which precedes said plate, each of the teeth being positioned to penetrate into the grooves of the satellite roller to disengage therefrom any encrusted materials.

4. A press according to claim 3, wherein there is a stack of said small plates, the long plates having a thickness which is slightly less than the widths of the gaps defined by the grooves.

5. A press according to claim 2, comprising in addition, at least one guide plate means associated with the pressure roller and positioned between two successive satellite rollers, being constituted from a stack of small plates which are alternately short and long, the portions of the long plates extending beyond the short small plates constituting the teeth of the fork and the upper part of the small plates defining a plane surface which is that of the plate, said guide plate guiding the material to be treated between the two satellite rollers, said guide plate carrying teeth forming a comb or fork turned toward and pointing at the satellite roller which precedes said plate, each of the teeth being positioned to penetrate into the grooves of the satellite roller to disengage therefrom any encrusted materials.

* * * * *